US009472852B2

(12) United States Patent
O'Shea et al.

(10) Patent No.: US 9,472,852 B2
(45) Date of Patent: Oct. 18, 2016

(54) INTEGRATED MIMO ANTENNA SYSTEM

(75) Inventors: Dermot O'Shea, San Diego, CA (US); Ronan Quinlan, Zhongli (TW)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 0 days.

(21) Appl. No.: 13/485,857

(22) Filed: May 31, 2012

(65) Prior Publication Data

US 2013/0321240 A1 Dec. 5, 2013

(51) Int. Cl.
*H01Q 21/00* (2006.01)
*H01Q 9/28* (2006.01)
*H01Q 21/28* (2006.01)

(52) U.S. Cl.
CPC ..... *H01Q 9/285* (2013.01); *H01Q 21/28* (2013.01)

(58) Field of Classification Search
CPC ..... H01Q 1/243; H01Q 1/38; H01Q 9/285; H01Q 21/28
USPC ..... 343/893, 824, 795, 700 MS
See application file for complete search history.

(56) References Cited

U.S. PATENT DOCUMENTS 3,747,114 A * 7/1973 Shyhalla ..... 343/795
5,270,721 A * 12/1993 Tsukamoto et al. ... 343/700 MS
7,327,317 B2 * 2/2008 Heiniger ..... 343/700 MS
7,724,201 B2 * 5/2010 Nysen et al. ..... 343/821
7,812,768 B2 * 10/2010 Liu et al. ..... 343/700 MS
8,228,238 B2 * 7/2012 Thiam et al. ..... 343/700 MS
2005/0035919 A1 * 2/2005 Yang et al. ..... 343/795
2010/0315313 A1 * 12/2010 Wu ..... 343/893
2011/0227793 A1 * 9/2011 Johnson ..... 343/700 MS
2012/0062433 A1 * 3/2012 Balanis et al. ..... 343/720

* cited by examiner

*Primary Examiner* — Dameon E Levi
*Assistant Examiner* — Hasan Islam
(74) *Attorney, Agent, or Firm* — Coastal Patent Law Group, P.C.

(57) ABSTRACT

An integrated MIMO antenna system is described wherein multiple antennas are fabricated on a single substrate. Antenna spacing and alignment is enhanced and controlled to a finer degree than with conventional discrete antenna fabrication techniques. Rotation of one or multiple antennas in relation to the other antennas in the system can be performed to within the accuracy of current photo-etching techniques. Metalized traces can be designed and etched on the single substrate and positioned between antenna elements to enhance inter-element isolation. The integrated MIMO antenna system can be fabricated on flexible printed circuit (FPC) material, or can be fabricated on rigid metallized substrate such as common FR4 materials. Portions of one or multiple antenna elements can be photo-etched on opposite sides of the substrate to provide an additional degree of freedom in terms of antenna placement, spacing, and rotation angle.

11 Claims, 8 Drawing Sheets

INTEGRATED MIMO ANTENNA SYSTEM

BACKGROUND OF THE INVENTION

1. Field of the Invention

This invention relates to antenna systems; and more particularly to an integrated antenna system adapted for multi-input multi-output (MIMO) operation.

2. Description of the Related Art

In view of continuous improvements within the field of wireless communication technology, the trend in the telecommunication industry is to move to $4^{th}$ generation, or 4G communication systems, for increased data rate requirements. The improved data rates achieved by 4G communication systems require multiple antennas on one or both ends of the communication link. This Multiple Input Multiple Output (MIMO) protocol and modulation scheme commonly requires multiple antennas operating in the same frequency band to be integrated into portable as well as stationary communication devices. The multiple antennas situated in the portable electronic devices, such as laptop computers, mobile phones, and personal digital assistants (PDAs) must work in unison to receive and transmit multiple data streams. These MIMO antennas are required to maintain high isolation and low pattern correlation for optimum link quality and to achieve the desired high data rates compared to 2G and 3G communication protocols. For portable electronic devices in particular, reduced size and reduced antenna inter-element spacing is required to integrate the multiple antennas into small and lightweight form factors.

Current antenna system design and integration techniques consist of designing a baseline antenna adapted to cover the frequency bands of interest, and then placing duplicates of this baseline design at various locations within the communication device to satisfy the MIMO antenna requirement. Care must be taken to insure that isolation, as well as low pattern correlation is maintained between the individual antennas. Low pattern correlation can be achieved by maintaining specific distances between antenna elements or by varying the polarization state of one antenna in the MIMO system compared to the other antennas in the system. The antenna design process is complicated by the multiple frequency bands that many MIMO antenna systems are required to cover.

The conventional multiple-band antenna such as a planar inverted-F antenna (PIFA) is generated from a two dimensional design. The PIFA can be provided from a printed circuit board (PCB) which has copper foil to be processed into a two dimensional shape, or can be provided as a three dimensional design from metal sheet forming processes. The two dimensional shape lends itself to photo-etching techniques on PCBs and aids in integration into portable electronic devices due to reduced volume of the two dimensional design.

The requirements for high isolation and low correlation between pairs of antennas also apply to 3G communication requirements such as receive diversity schemes for improved signal reception in multi-path environments. As in 4G communication systems, antenna spacing and orientation of one antenna in relation to the other antennas are important in 3G antenna systems to provide for improved data rates and connectivity.

Additionally, Wifi and wireless local area network (WLAN) communication devices also require multiple antenna systems where stringent spacing and orientation requirements are needed to provide for improved signal transmission and reception. Two antenna systems for Wifi and WLAN have been the norm for several years due to the benefits of spatial diversity between pairs of antennas in defeating the effects of deep signal fades due to multi-path reception.

With the requirement of maintaining a specific spacing between antenna elements in a MIMO antenna system for maintaining high isolation and low pattern correlation, a solution for integrating multiple antennas into a portable electronic device as well as stationary devices is needed, wherein inter-element spacing between antenna elements can be maintained in a production setting, such that automated or manual assembly techniques can be reliably implemented.

SUMMARY OF THE INVENTION

In certain embodiments, a single integrated antenna assembly is provided comprising multiple antenna elements within a multi-input multi-output (MIMO) antenna system, wherein the spacing and orientation of each antenna element is maintained to a high degree of accuracy. The antennas are fabricated on a single substrate using a photo etching technique for providing improved control over antenna spacing and orientation within a production environment and maintaining improved consistency across a large production lot.

In one embodiment of the present invention, a baseline antenna design is duplicated at set spacings on a single thin flexible substrate (Flexible Printed Circuit, or "FPC"). The photo-etching technique used to fabricate FPCs provides a much higher degree of accuracy for inter-element spacing in the MIMO antenna system when compared to the individual placement of discrete antennas. In this regard, the orientation of the antenna elements in relation to the other antennas in the system is accurately set during the process where the artwork for the photo-etching is designed.

In another embodiment, a rigid substrate can be used to fabricate the antenna elements of the MIMO antenna system. The rigid substrate provides a self-supporting antenna assembly that can be attached to the portable electronic device. As with the FPC fabrication technique, the spacing and inter-element orientation can be very accurately maintained by using the photo-etching technique.

In another embodiment, one or more conductors can be etched between the individual antenna elements, with the conductors positioned, oriented and dimensioned to improve isolation between adjacent antenna elements. A ground pad can be designed into the FPC substrate to allow for grounding of the conductor; or alternatively the conductor can be left ungrounded. The one or more conductors can be individually shaped and dimensioned to provide improved isolation at multiple frequency bands.

In another embodiment of the present invention, portions of an antenna element can be etched on opposite sides of a substrate. For example, the low frequency portion of the antenna can be etched on a first side of a substrate, with the high frequency portion of the antenna etched on a second side of the substrate opposite of the first side. Additional antenna elements can be positioned and etched on a common substrate. This technique provides for a closer grouping of antennas. It also provides for more area to rotate specific portions of one or all antennas on the single substrate assembly.

In another embodiment, a first set of antennas tuned to operate at a first frequency band can be positioned at an optimal spacing. A second set of antennas can be interleaved with the first set of antennas, with the second set of antennas tuned to a second frequency band different from the first frequency band. The position of the antennas in the second set of antennas can be optimized for the second frequency band. The resultant antenna assembly on a single substrate will provide an optimized set of antennas for MIMO operation at two distinct frequency bands. This technique can be extended to include additional sets of antennas to cover additional frequency bands on the same single substrate.

In another embodiment, a baseline antenna design is duplicated at set spacing on a single thin flexible substrate (Flexible Printed Circuit, or "FPC"). The baseline and the duplicate second antenna are used to form a receive diversity antenna system. The photo-etching technique being used to fabricate FPCs provides a much higher degree of accuracy for inter-element spacing within the receive diversity system when compared to individual placement of discrete antennas. The orientation of the antenna elements in relation to the other antennas in the system is accurately set during the process in a position where the artwork for the photo-etching is designed.

In yet another embodiment, certain methods are disclosed for fabricating a multi-input multi-output (MIMO) antenna adapted for use in a wireless communications device while providing effective signaling with high isolation and low pattern correlation between the multiple antennas.

Other features and benefits will become apparent hereinafter to those having skil in the art.

DETAILED DESCRIPTION OF THE PREFERRED EMBODIMENTS

Figure 1:
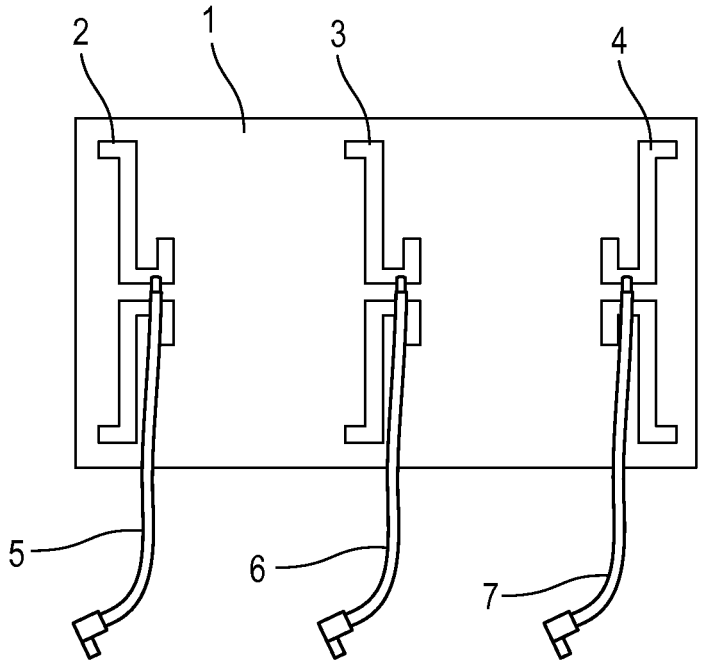
FIG. 1 illustrates a multi-antenna assembly fabricated on a single flexible substrate in accordance with various embodiments of the invention.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment, the invention provides a multi-input multi-output (MIMO) antenna system comprising a plurality of antenna elements disposed on a single substrate. The plurality of antenna elements are optimally positioned and spaced apart from one another to maintain high isolation and low pattern correlation therebetween. In order to accurately position and space the antenna elements, a photo-etching technique is used to fabricate the antennas onto the substrate.

Within the general embodiment, the MIMO antenna system comprises a first antenna element and a second antenna element being optimally positioned and spaced apart from one another to provide high isolation and low pattern correlation. Optionally, a third, fourth, or additional antenna element may be provided to form a multi-antenna element array.

Each of the antenna elements may comprise a duplicate of a dimensioned antenna designed for resonance at one or more desired frequency bands. Alternatively, the antenna elements may comprise a group of first dimensioned antennas designed to resonate at one or more first frequency bands, and a group of second dimensioned antennas designed to resonate at one or more second frequency bands being distinct from the first frequency bands. Additional groups of successively dimensioned antennas may be incorporated.

In certain embodiments, the substrate is a flexible substrate, such as a thin dielectric sheet or plastic.

In certain other embodiments, one or more passive conductors are disposed between the antenna elements of the multi antenna MIMO system. The passive conductors can be positioned and dimensioned to alter isolation between antenna elements of the MIMO system.

In certain other embodiments, the MIMO antenna system comprises a first antenna element and a second antenna element being rotated with respect to the first antenna element. The angle of rotation between the first and second antenna elements can be selected to provide a specific pattern correlation level therebetween. Additionally, the angle of rotation between the first and second antennas can be selected to alter the isolation therebetween. Additional antenna elements can be incorporated and rotationally oriented with respect to one or more other antenna elements for altering a specific correlation level, or the isolation between the antennas.

In certain other embodiments, one or more first antenna elements are formed on a first planar surface of a single substrate, and one or more second antenna elements are formed on a second planar surface of the single substrate opposite of the first planar surface. The first and second antenna elements may be connected to each using a conductive via or plated thru hole extending through the substrate. Each of the connected first and second antenna elements forms an antenna pair, wherein each of the antenna pairs may be similarly dimensioned to resonate at one or more common frequency bands for MIMO operation.

In certain other embodiments, first and second antenna elements are disposed on a common substrate and configured for operation in accordance with a transmit/receive diversity, or receive diversity scheme.

Within the integrated MIMO antenna system according to various embodiments of the invention, antenna spacing and alignment can be enhanced and controlled to a finer degree than with conventional discrete antenna fabrication techniques. Rotation of one or multiple antennas in relation to the other antennas in the system can be performed to within the accuracy of current photo-etching techniques. Metalized traces can be designed and etched on the single substrate and positioned between antenna elements to enhance inter-element isolation. The integrated MIMO antenna system can be fabricated on flexible printed circuit (FPC) material, or can be fabricated on rigid metalized substrate such as common FR4 materials. Portions of one or multiple antenna elements can be photo-etched on opposite sides of the substrate to provide an additional degree of freedom in terms of antenna placement, spacing, and rotation angle.

In yet another embodiment, a method for forming an integrated antenna system comprises: photo-etching two or more antenna elements on a substrate, the antenna elements being similar in dimension and adapted to resonate at one or more common frequency bands; positioning and spacing the two or more antenna elements on the substrate to optimize isolation and correlation patterns therebetween; and connecting a separate transmission line to each of the antenna elements. The method may further comprise the step of: surface-mounting one or more surface mounted components selected from the group consisting of: resistors, capacitors, and inductors to a conductive trace of the antenna elements.

Various features and advantages of this invention will become apparent from the following description of embodiments with reference to the accompanying drawings. Hereinafter, certain preferred embodiments of the present invention will be described in more detail referring to the drawings and reference numerals associated therewith.

Now turning to the drawings, FIG. 1 illustrates a multi-antenna system comprising three antenna elements 2, 3, and 4 fabricated on a single substrate 1. Transmission lines 5, 6, and 7 are connected to the respective feed points of antennas 2, 3, and 4. The antennas can be accurately positioned and spaced apart in relation to each other for use as a multiple-input multiple-output (MIMO) antenna system. This is accomplished using a photo etching technique, which is generally more accurate than individual placement of the antenna elements in a portable communication device.

Figure 2:
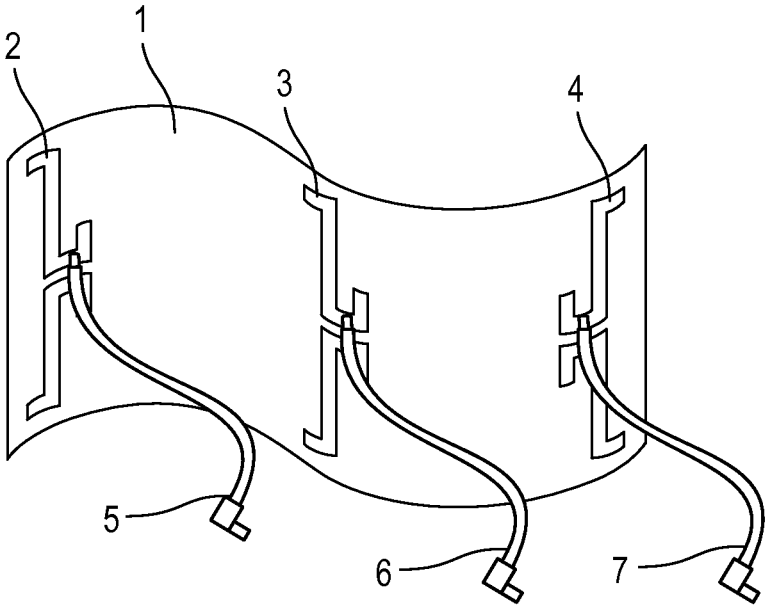
FIG. 2 illustrates a multi-antenna assembly fabricated on a flexible substrate with the substrate being formed in a three-dimensional shape.

FIG. 2 illustrates a three-antenna system consisting of antenna elements 2, 3, and 4 fabricated on a single substrate 1, wherein the substrate is thin and flexible. Transmission lines 5, 6, and 7 are connected to the feed points of antenna elements 2, 3, and 4. When used for multiple-input multiple-output (MIMO) antenna systems, the flexible characteristics of the substrate provide for accurate spacing and positioning of the antennas in a three dimensional form factor within a portable communication device.

Figure 3:
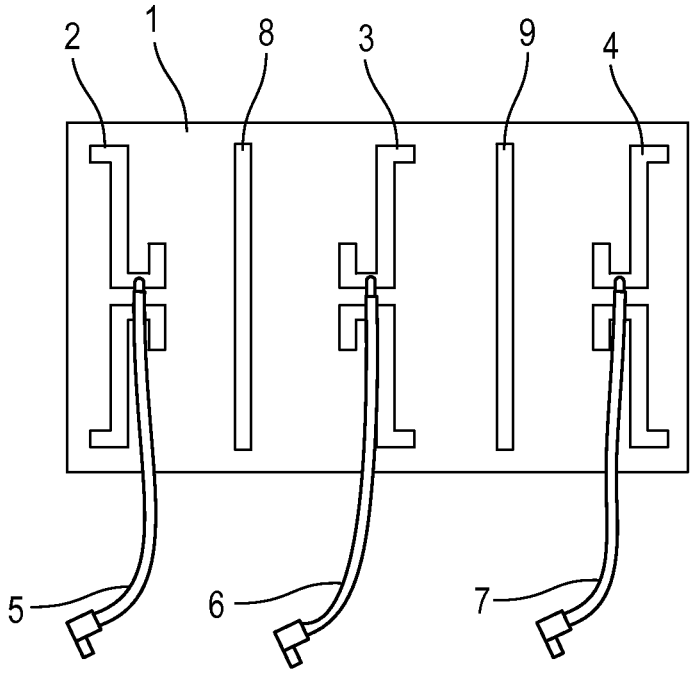
FIG. 3 illustrates a multi-antenna assembly having passive conductors positioned between the individual antenna elements; all antenna elements and respective passive conductors are fabricated on a single substrate.

FIG. 3 illustrates a three-antenna system comprising antenna elements 2, 3, and 4 fabricated on a single substrate 1. Transmission lines 5, 6, and 7 are connected to the feed points of antenna elements 2, 3, and 4. Passive conductive elements 8 and 9 are positioned between antennas 2, 3, and 4. Passive conductive elements 8 and 9 can be adjusted in length and position to alter the isolation between adjacent antenna elements. When used for multiple-input multiple-output (MIMO) antenna systems, improved isolation will result in increased data rates.

Figure 4:
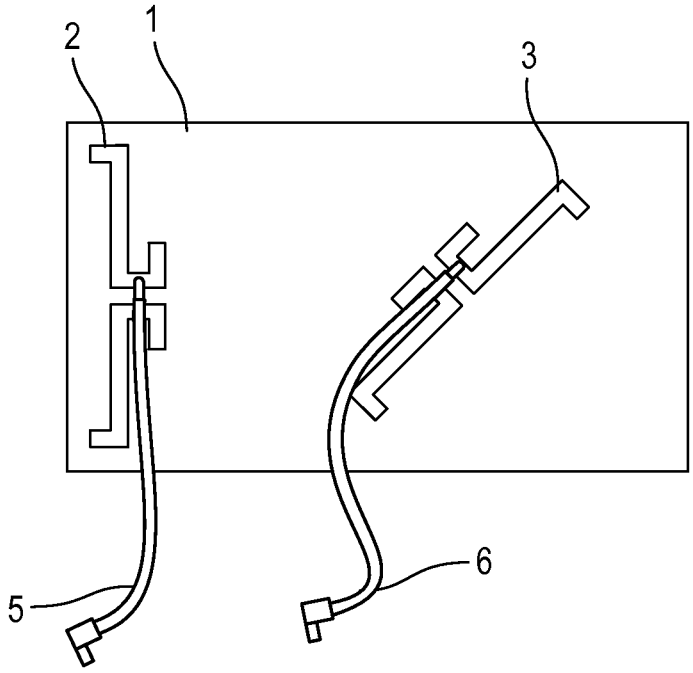
FIG. 4 illustrates a two-antenna assembly fabricated on a single substrate, with the orientation of the second antenna element being rotated with respect to the first antenna element.

FIG. 4 illustrates a two-antenna system comprising antenna elements 2, and 3 fabricated on a single substrate 1. Transmission lines 5, and 6 are connected to the feed points of antenna elements 2, and 3. Antenna element 3 is rotated with respect to antenna element 2. Rotation of antenna 3 results in a reduction in pattern correlation between antennas 2 and 3. When used for multiple-input multiple-output (MIMO) antenna systems, reduced pattern correlation results in increased data rates. Additionally, having both antennas fabricated on a common substrate provides a low cost and accurate method of maintaining a specific antenna spacing and rotation angle between the two antennas such that isolation and correlation management can be optimized between the multiple antenna elements.

Figure 5:
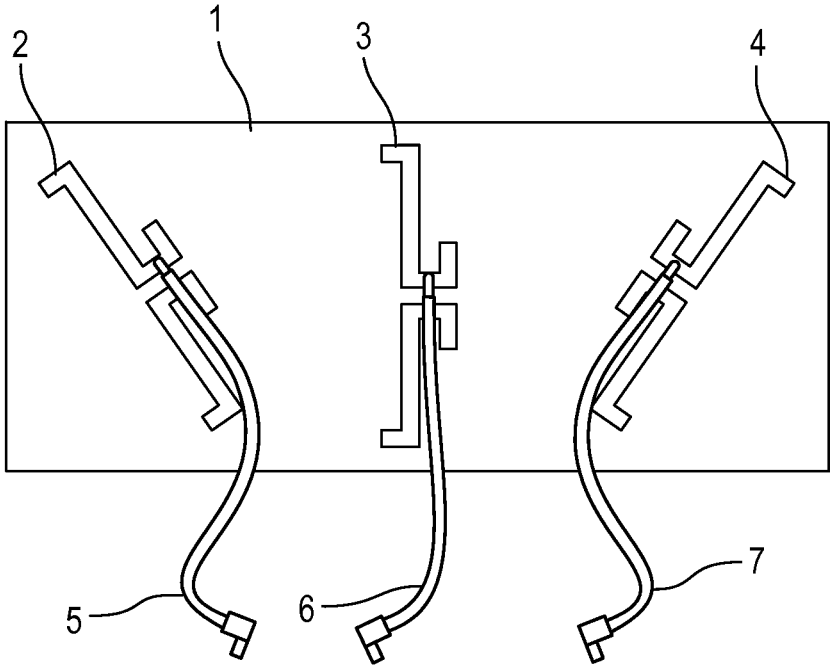
FIG. 5 illustrates a three-antenna assembly fabricated on a single substrate, with the orientation of the first and third antenna elements being rotated with respect to the second antenna element.
Figure 6A:
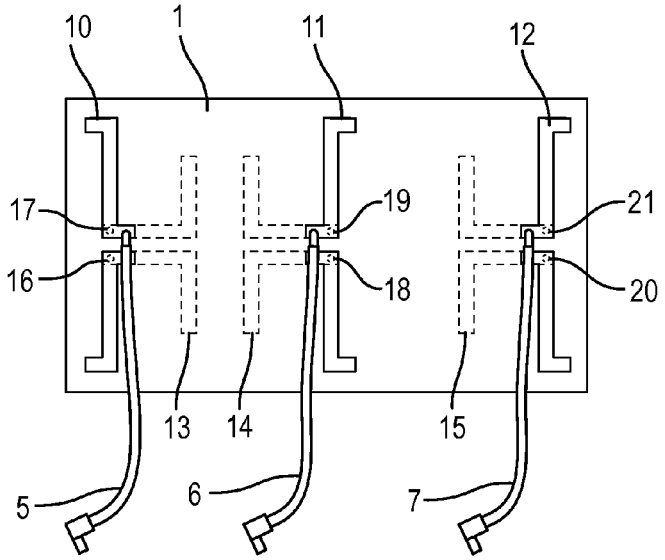
FIGS. 6(A-D) illustrate a three-antenna assembly wherein portions of each antenna element are fabricated on opposite planar sides of the substrate, with the portions of the antenna elements being connected using conductive vias extending through the substrate from the first planar side to the second planar side.
Figure 6B:
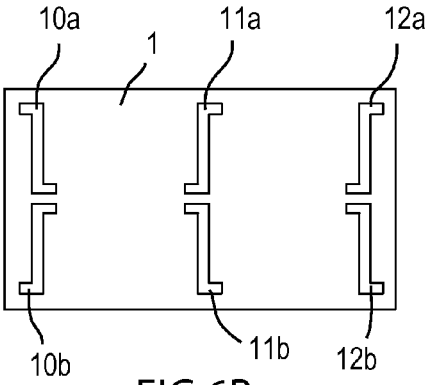
Figure 6C:
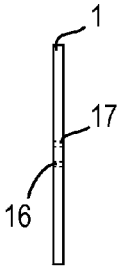
Figure 6D:
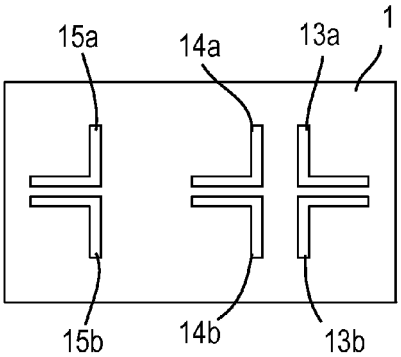

FIG. 5 illustrates a three-antenna system comprising antenna elements 2, 3, and 4 fabricated on a single substrate 1. Transmission lines 5, 6, and 7 are connected to the feed points of antenna elements 2, 3, and 4. Antennas elements 2 and 4 are individually rotated with respect to antenna 3, with antenna element 2 being oriented up to ninety degree counter-clockwise with respect to antenna element 3 and antenna element 4 being oriented up to ninety degrees clockwise with respect to antenna element3. With the rotation of antenna elements 2 and 4, a reduction in pattern correlation between any two antenna pairs is achieved. As discussed above, when used for multiple-input multiple-output (MIMO) antenna systems, reduced pattern correlation will result in increased data rates. As with the above two-antenna embodiment, by having all three antenna elements fabricated on a common substrate -a low cost and accurate method of maintaining a specific antenna spacing and rotation angle between the three antennas is achieved. As shown in FIG.5, first antenna element 2 is disposed on the substrate. Second antenna element 3 is disposed on the substrate adjacent to first antenna element 2 and oriented about forty five degrees in a clockwise rotation with respect to first antenna element 2. Third antenna element 4 is disposed on the substrate adjacent to second antenna element 3 and oriented about forty five degrees in a clockwise rotation with respect to second antenna element 3. In this regard, third antenna element 4 is oriented about ninety degrees in clockwise rotation with respect to first antenna element 2.

FIG. 6 illustrates a three-antenna system with portions of each three-dimensional antenna being fabricated on two opposing sides of a single substrate. A first antenna element comprises antenna portions 10*a;* 10*b* positioned on a first side of substrate 1, and antenna portions 13*a;* 13*b* positioned on a second side of substrate 1 opposite of the first side. Vias 16 and 17, formed by conductive thru holes, are used to connect antenna portions 10*a;* 10*b* to antenna portions 13*a;* 13*b*, respectively. A transmission line 5 is connected to the feed point of the antenna formed by elements 10 and 13. A second antenna element comprises antenna portion 11 positioned on the first side of substrate 1, and antenna portion 14 positioned on the second side of substrate 1. Vias 18 and 19, formed by conductive thru holes, are used to connect antenna portion 11 to antenna portion 14. A transmission line 6 is connected to the feed point of the antenna formed by elements 11 and 14. A third antenna element comprises antenna portion 12 positioned on the first side of substrate 1, and antenna portion 15 positioned on the second side of substrate 1. Vias 20 and 21, formed by conductive thru holes, are used to connect antenna portion 12 to antenna portion 15. A transmission line 7 is connected to the feed point of the antenna element formed by antenna portions 12 and 15. Positioning portions of one or more of the antennas in an antenna system on both sides of the substrate provides additional flexibility in placement of the respective antenna elements. For example, low frequency portions of each antenna can be positioned on one side of the substrate, and high frequency portions of each antenna can be positioned on an opposite side of the substrate. Spacing between the low and high band frequency portions can be fine-tuned and optimized per frequency band for the two-band antenna.

Figure 7A:
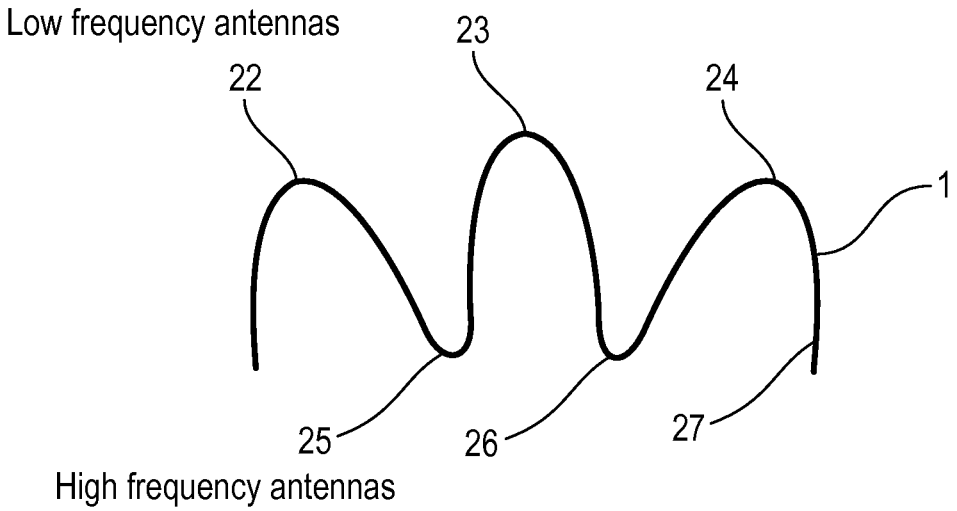
FIGS. 7(A-B) illustrate a top view of a MIMO antenna assembly, the MIMO antenna assembly comprising three low frequency antennas and three high frequency antennas; wherein shaping the flexible substrate provides an ability to adjust the inter-element spacing of both the low frequency and high frequency MIMO arrays.
Figure 7B:
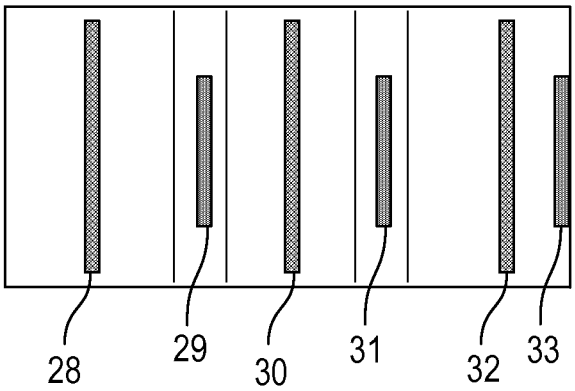

FIG. 7(A-B) illustrates a MIMO antenna system comprising three low frequency antennas 22, 23, and 24 and three high frequency antennas 25, 26, and 27. A flexible substrate 1 is shaped into a three-dimensional structure to optimally space both the high and low frequency antennas. Six transmission lines 28, 29, 30, 31, 32, and 33 are attached to the feed points of the antennas. Shaping the flexible substrate provides the ability to adjust the inter-element spacing of each MIMO array.

Figure 8:
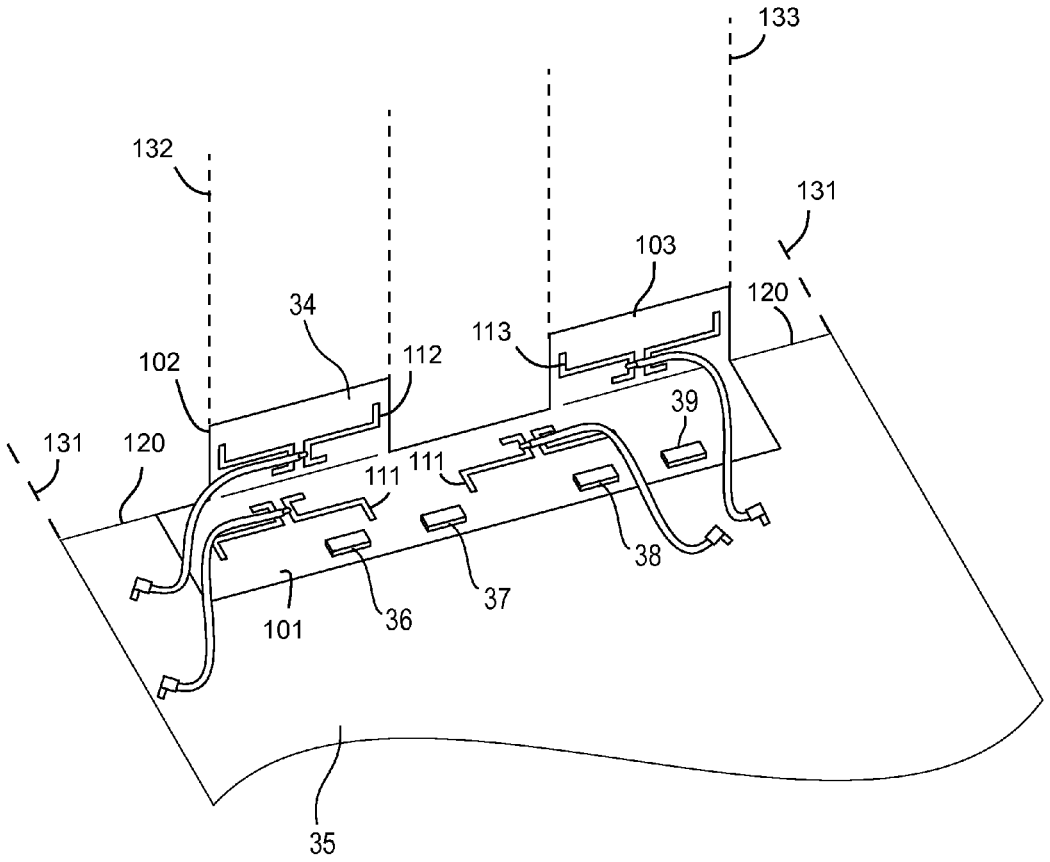
FIG. 8 illustrates an antenna assembly formed into a three-dimensional volume; wherein conductive features are designed into the antenna assembly to provide for mechanical attachment to the host PCB.

FIG. 8 illustrates a MIMO antenna system comprising a four-antenna assembly 34 connected to a printed circuit board (PCB) 35 of a portable electronic device. Conductive pads 36, 37, 38, and 39 are designed into antenna assembly 34 and are soldered to conductive elements such as similar pads or a ground plane of the PCB 35 to provide mechanical attachment for the antenna assembly 34 to the PCB 35. The antenna assembly 34 is formed into a three-dimensional shape and allows for antennas to be positioned in multiple planes. In this regard, a number of conductive pads 36-39 of the flexible antenna assembly 34 may comprise a solder primer or coating such that when the antenna is placed over the PCB 35 of the device and heat is applied, the antenna may become permanently affixed to the PCB. Note that the three-dimensional flexible antenna substrate can be bent or shaped after affixing solder points to the PCB. Thus, additional customization of the antenna is possible after mating with the PCB. Such a soldering technique provides high-throughput manufacturing while preserving the isolation and correlation benefits of the antenna. As shown, the MIMO antenna system includes: a circuit board 35 having a top surface and a periphery 120 thereof; and a flexible substrate having a first portion 101 attached to the to surface of the circuit board and a second portion 102 and third portion 103 each extending outwardly from the first portion at the periphery of the circuit board and expanding into free-space. The first portion 101 of the flexible substrate includes a pair of fixed-antenna elements 111*a*; 111*b* each being fixedly positioned about the circuit board adjacent to the periphery. The fixed-antenna elements are contained in a fixed-antenna plane 131. The second portion 102 of the flexible substrate includes a first configurable-antenna element 112 disposed thereon, with the second portion and first configurable-antenna element thereon being contained in a first configurable-antenna plane 132. Finally, the third portion 103 of the flexible substrate includes a second configurable-antenna element 113 disposed thereon, with the third portion and second configurable-antenna element being contained in a second configurable-antenna plane 133.

Figure 9A:
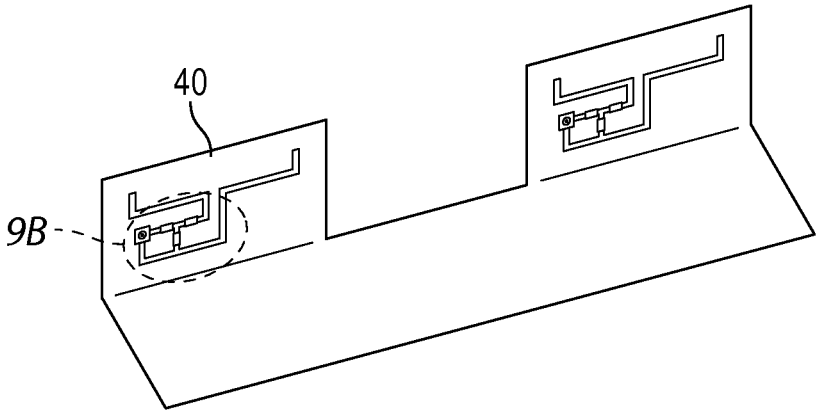
FIGS. 9(A-B) illustrate an antenna assembly wherein surface mount technology (SMT) is used to attach components such as coaxial connectors and components for impedance matching to the substrate.
Figure 9B:
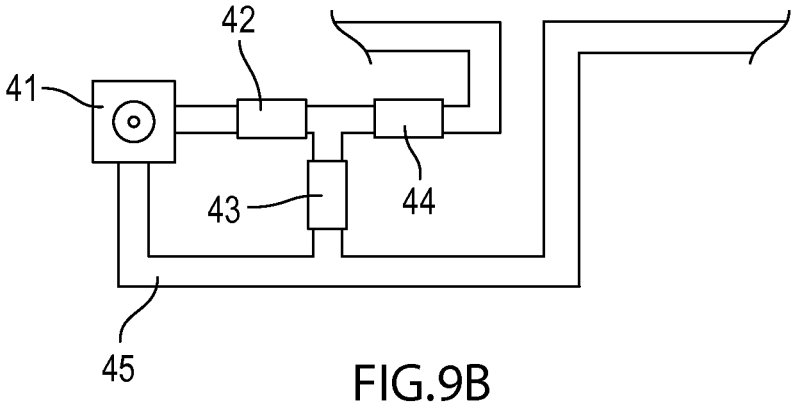

FIG. 9 illustrates a MIMO antenna assembly 40 formed into a three-dimensional form. A Surface Mount Technology (SMT) connector 41 is attached to the substrate of antenna assembly 40. SMT components 42, 43, and 44 are connected to conductive traces 45 etched into the substrate of antenna assembly 40. Components 42, 43, and 44 may comprise resistors, capacitors, inductors, or other devices used to alter the impedance, insertion phase, or other electrical characteristics of the antennas formed on antenna assembly 40.

Figure 10:
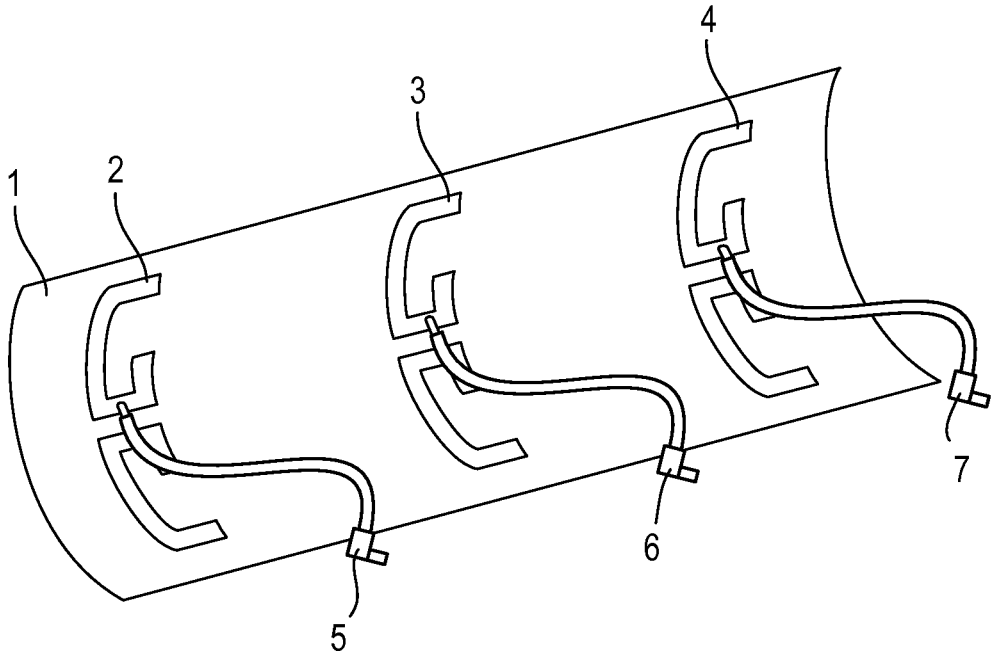
FIG. 10 illustrates an antenna assembly formed into a three-dimensional volume with a continuous curvature; the three-antenna elements of the antenna assembly follow the profile of the curved flexible substrate, thereby providing a mechanism for accurate forming and locating of the three antenna elements.

FIG. 10 illustrates a multi-antenna assembly formed into a three-dimensional form having a continuous curvature profile. The three antenna system comprises antenna elements 2, 3, and 4 fabricated on a single substrate 1. Transmission lines 5, 6, and 7 are connected to the feed points of antenna elements 2, 3, and 4. The three antennas fabricated on the flexible substrate follow the curvature of the substrate, providing for the ability to form antennas with a continuous curvature.

Although the present invention has been described with reference to the foregoing preferred embodiments, it will be understood that the invention is not limited to the details thereof. Various equivalent variations and modifications will be recognized by those skilled in this art in view of the teachings herein. Thus, all such variations and equivalent modifications are also embraced within the scope of the invention as defined in the appended claims.

What is claimed is:

1. An integrated multi-input multi-output (MIMO) antenna system, comprising:

a rigid circuit board having a top surface and a periphery thereof;

a flexible substrate having a first portion thereof being disposed on the top surface of the circuit board and having at least a second portion thereof further expanding beyond the periphery of the circuit board into free space;

the first portion of the flexible substrate comprising:

at least one fixed-antenna element, the at least one fixed-antenna element being configured in a fixed position about the circuit board and within a fixed-antenna plane, and two or more conductive pads, each of the two or more conductive pads being individually configured for attachment with a conductive element or ground associated with the rigid circuit board;

the second portion of the flexible substrate comprising:

at least one configurable-antenna element, the configurable-antenna element being configured in a first configurable-antenna plane and adapted for adjustable positioning about the fixed-antenna plane;

wherein the configurable-antenna element is configurable for positioning within the fixed-antenna plane, and wherein the configurable-antenna element is alternatively configurable for positioning within a distinct plane with respect to the fixed-antenna plane upon bending the second portion of the flexible substrate expanding beyond the periphery of the circuit board.

2. The antenna system of claim 1, wherein the first portion of the flexible substrate comprises a first fixed-antenna element and a second fixed-antenna element.

3. The antenna system of claim 2, wherein each of the first and second fixed-antenna elements is positioned adjacent to the periphery of the circuit board.

4. The antenna system of claim 1, the flexible substrate further comprising:

a third portion, the third portion comprising:

a second configurable-antenna element, the second configurable-antenna element being configured in a second configurable-antenna plane adapted for adjustable positioning about the fixed-antenna plane.

5. The antenna system of claim 4, wherein each of the first and second configurable-antenna planes is individually configured about the fixed-antenna plane.

6. The antenna system of claim 5, wherein the first configurable-antenna plane containing the first configurable-antenna element is distinct from the second configurable-antenna plane containing the second configurable-antenna element.

7. The antenna system of claim 2, wherein one of the first fixed-antenna elements is positioned on a first side of the periphery adjacent to one of the configurable-antenna elements being positioned on a second side of the periphery.

8. The antenna system of claim 7, wherein the first configurable-antenna plane is oriented up to ninety degrees with respect to the fixed-antenna plane.

9. The antenna system of claim 1, said first configurable-antenna plane being bent about the periphery of the circuit board to form a three-dimensional antenna structure.

10. The antenna system of claim 1, at least a portion of the flexible substrate being bent to form a continuous curvature profile.

11. An integrated multi-input multi-output (MIMO) antenna system, comprising:

a rigid circuit board having a top surface and a periphery thereof;

a flexible substrate having a first portion thereof being disposed on the top surface of the circuit board, and a second portion and third portion thereof each further expanding beyond the periphery of the circuit board into free space;

the first portion of the flexible substrate comprising:

at least one fixed-antenna element, the at least one fixed-antenna element being configured in a fixed position about the circuit board and within a fixed-antenna plane, and two or more conductive pads, each of the two or more conductive pads being individually configured for attachment with a conductive element or ground associated with the rigid circuit board;

the second portion of the flexible substrate comprising:

at least a first configurable-antenna element, the first configurable-antenna element being configured in a first configurable-antenna plane and adapted for adjustable positioning about the fixed-antenna plane; and the third portion of the flexible substrate comprising:

at least a second configurable-antenna element, the second configurable-antenna element being configured in a second configurable-antenna plane and adapted for adjustable positioning about the fixed-antenna plane;

wherein each of the first and second configurable-antenna elements is individually configurable for positioning within the fixed-antenna plane, and wherein each of the first and second configurable-antenna elements is alternatively configurable for positioning within a distinct plane with respect to the fixed-antenna plane upon bending about the periphery of the circuit board.

* * * * *